US005542574A

United States Patent [19]

Stern

[11] Patent Number: 5,542,574

[45] Date of Patent: Aug. 6, 1996

[54] AIR DRIVEN CONDIMENT DISPENSER

[76] Inventor: Leif E. Stern, Sjögräsgatan 2, S-234 33 Lomma, Sweden

[21] Appl. No.: 270,932

[22] Filed: Jul. 5, 1994

[30] Foreign Application Priority Data

Jul. 8, 1993 [SE] Sweden ..... 9302366

[51] Int. Cl.[6] ..... B67D 5/52

[52] U.S. Cl. ..... 222/137; 222/144.5; 222/145.2; 222/145.3; 222/145.7; 222/309; 222/380; 222/389; 222/485

[58] Field of Search ..... 222/135, 137, 222/144.5, 145.1, 145.2, 145.3, 145.7, 309, 340, 380, 389, 485, 651; 403/331

[56] References Cited

U.S. PATENT DOCUMENTS

| | | | |
|---|---|---|---|
| 3,850,345 | 11/1974 | Merritt | 222/168.5 |
| 3,865,281 | 2/1975 | Byrd et al. | 222/309 X |
| 4,032,044 | 6/1977 | Flynn et al. | 222/380 X |
| 4,403,885 | 9/1983 | Babb | 403/331 X |
| 5,022,556 | 6/1991 | Dency et al. | 222/309 X |
| 5,033,646 | 7/1991 | McCann et al. | 222/69 |
| 5,158,210 | 10/1992 | Du | 222/144.5 X |
| 5,322,418 | 6/1994 | Comer | 222/389 X |
| 5,366,117 | 11/1994 | Mesenbring et al. | 222/135 X |
| 5,435,462 | 7/1995 | Fujii | 222/389 X |

FOREIGN PATENT DOCUMENTS

| | | | |
|---|---|---|---|
| 462713 | 8/1990 | Sweden . | |
| 8001376 | 7/1980 | WIPO . | |
| 8806138 | 8/1988 | WIPO . | |
| 9100219 | 10/1991 | WIPO | 222/380 |

*Primary Examiner*—Andres Kashnikow
*Assistant Examiner*—Joseph A. Kaufman
*Attorney, Agent, or Firm*—Tarolli, Sundheim, Covell, Tummino & Szabo

[57] ABSTRACT

The present invention relates to a portioning arrangement for portioning out liquid foodstuffs. For quick and easy disassembly of the portioning arrangement for cleaning of the parts thereof interlarded with foodstuff, a dispensing device (10) forming part of the portioning arrangement is releasable from a drive piston (17) driving the device (10), and the dispensing device (10) is also retractable or removable from a portioning chamber (11) of a dispensing unit (38), whereby the dispensing device (10) and the portioning chamber (11) can be easily cleaned separately.

25 Claims, 6 Drawing Sheets

AIR DRIVEN CONDIMENT DISPENSER

BACKGROUND OF THE INVENTION

The present invention relates to a portioning arrangement for portioning out liquid foodstuffs, e.g. ketchup and/or mustard to at least one item of food, e.g. a hamburger, whereby a drive arrangement exhibits at least one pressure-medium-driven, primarily compressed-air-driven, drive piston, whereby a dispensing unit comprises at least one portioning chamber wherein a dispensing device is insertable, whereby the drive piston is arranged to impart to the dispensing device portioning strokes for portioning out foodstuff from the portioning chamber and via at least one portioning tube and a portioning nozzle to the food, whereby the dispensing device is intended to be subjected to a return motion after the portioning stroke in order to generate such a negative pressure in the portioning chamber that food is drawn into the portioning chamber from at least one container and whereby the portioning nozzle is provided on an operating lever which can be held in the hand for directing said portioning nozzle towards the food to be provided with foodstuff.

For dispensers or portioning arrangements of the above type, it is essential for hygienic reasons to be able to clean those parts which are brought in contact with the foodstuff. Since this must be done after each day of use of the dispenser and by different persons, it is important that any person quickly and without tools can disassemble the dispenser such that parts interlarded with foodstuff are exposed for efficient cleaning.

The object of the present invention is to permit this by disassemble the least possible number of parts and still get access to the parts interlarded with foodstuff.

Since the dispensing device can be disassembled from the drive piston and withdrawn from the portioning chamber, all parts of the dispensing device as well as the portioning chamber which might be interlarded with foodstuff are exposed and said parts of the dispensing device and of the portioning chamber are cleaned separately.

BRIEF DESCRIPTION OF THE DRAWINGS

The invention will be explained in detail below with reference to the attached drawings, on which

DESCRIPTION OF PREFERRED EMBODIMENT

Figure 1:
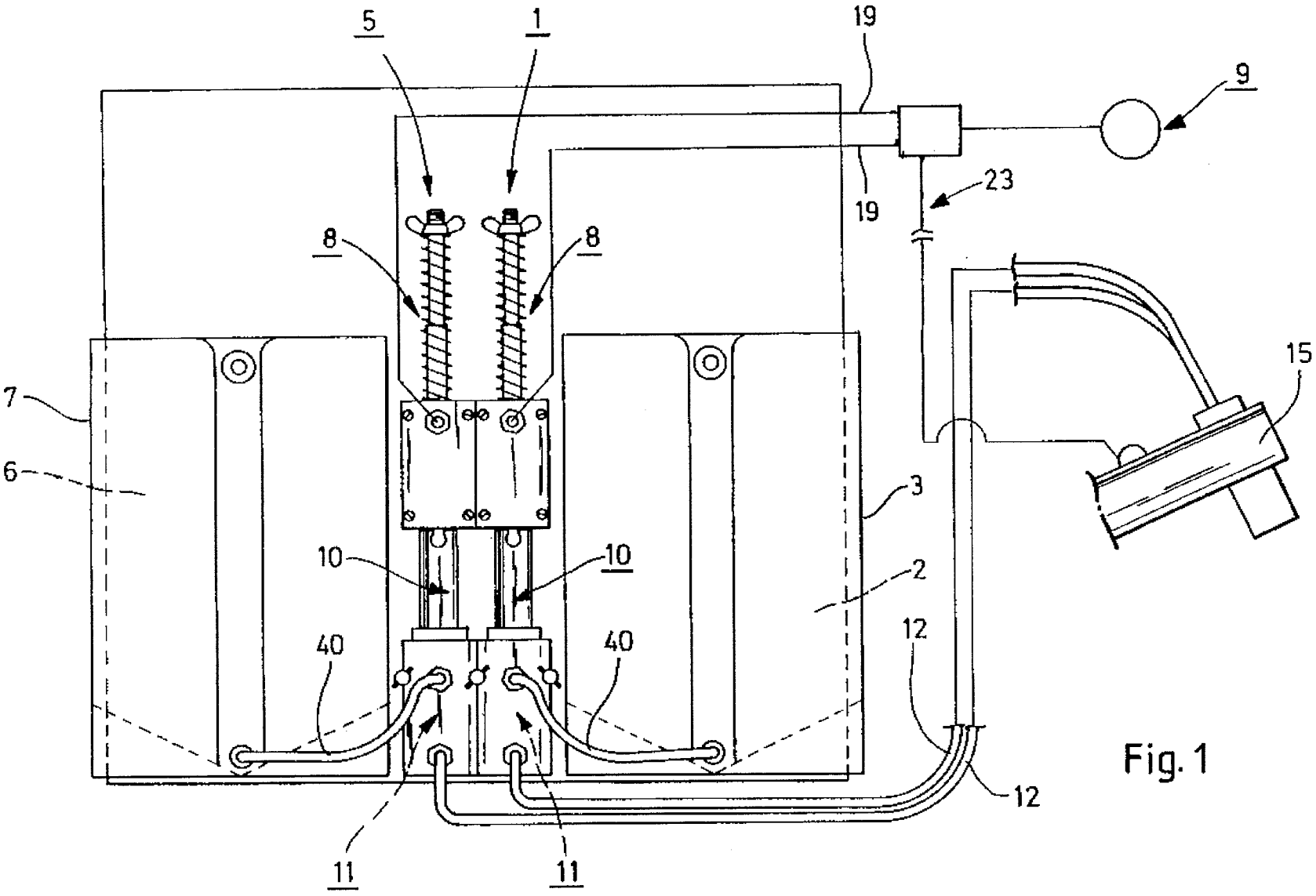
FIG. 1 illustrates a portioning arrangement according to the invention with a plan view.

The portioning arrangement illustrated in FIG. 1 shows a unit 1 for portioning out ketchup 2 from a ketchup container 3 to a hamburger 4, and a unit 5 for portioning out mustard

6 from a mustard container 7 to the hamburger 4.

Figure 2:
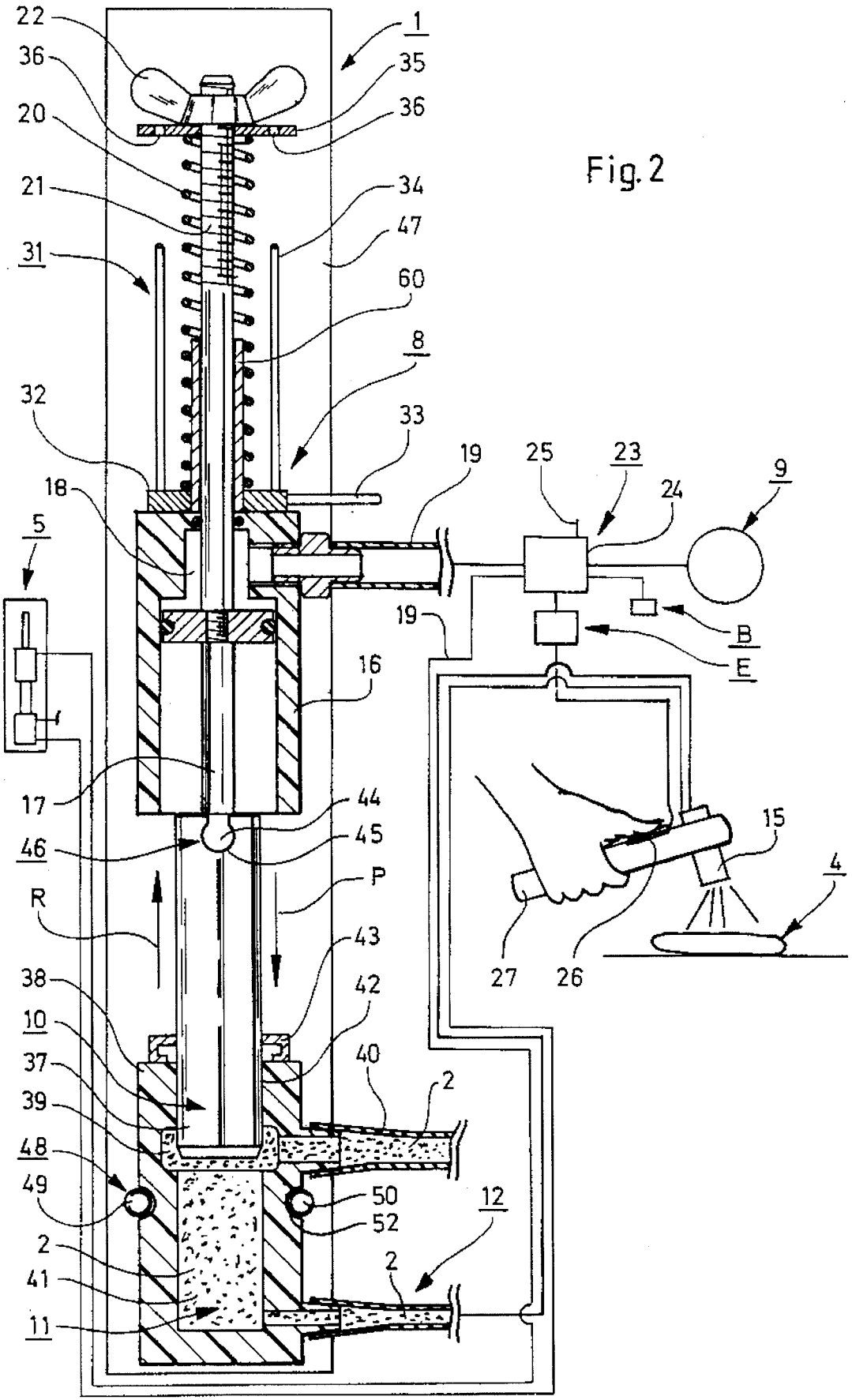
FIG. 2 illustrates a part of the portioning arrangement according to FIG. 1, partially in section.
Figure 3:
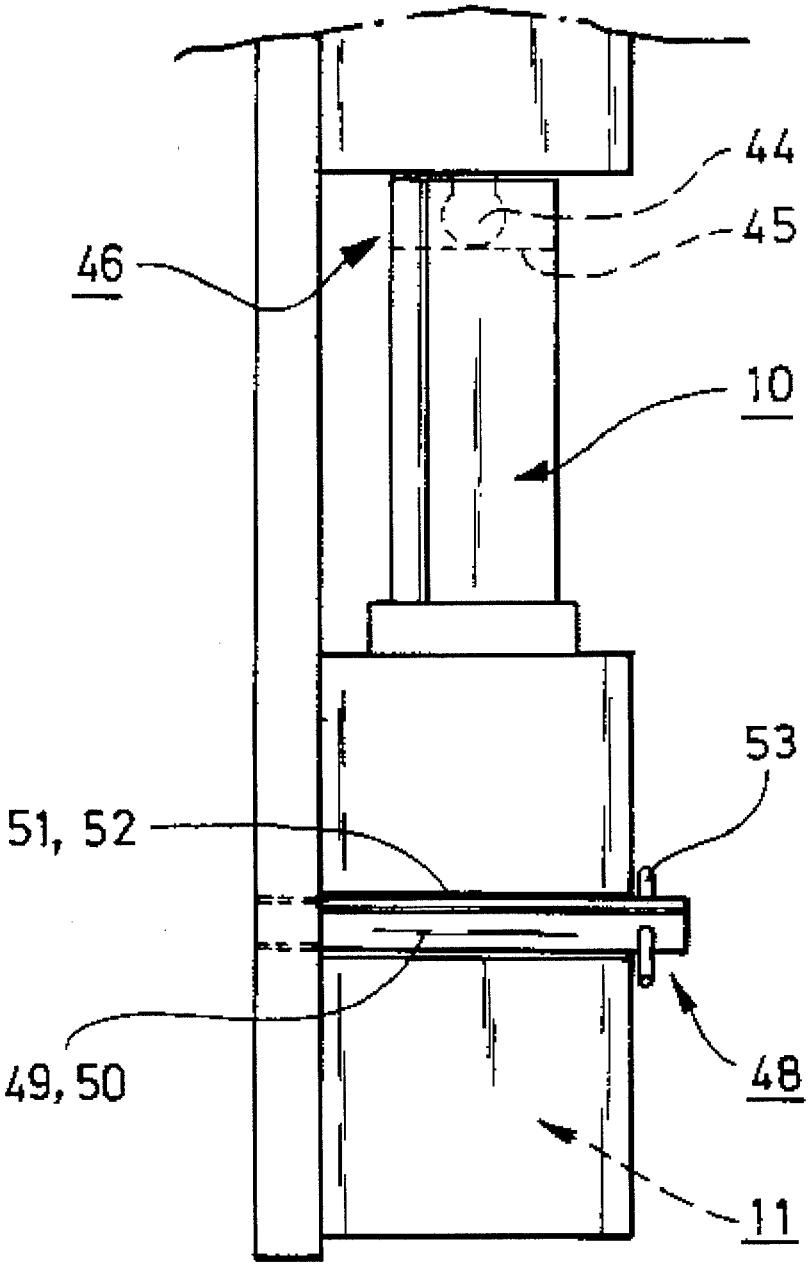
FIG. 3 illustrates parts of the portioning arrangement in FIG. 2 with a side view.
Figure 4:
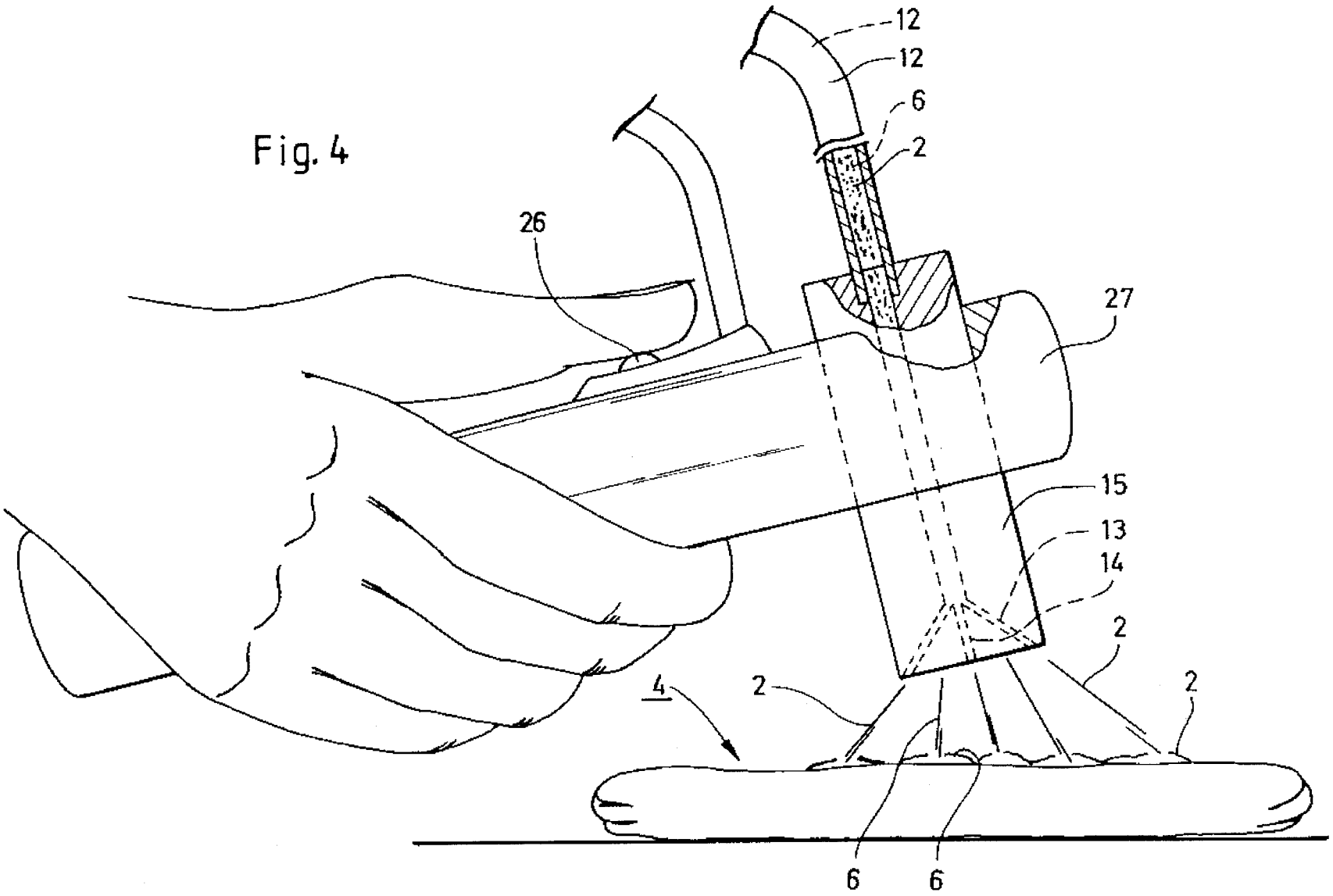
FIG. 4 illustrates a portioning nozzle forming part of the portioning arrangement according to the invention.
Figure 6:
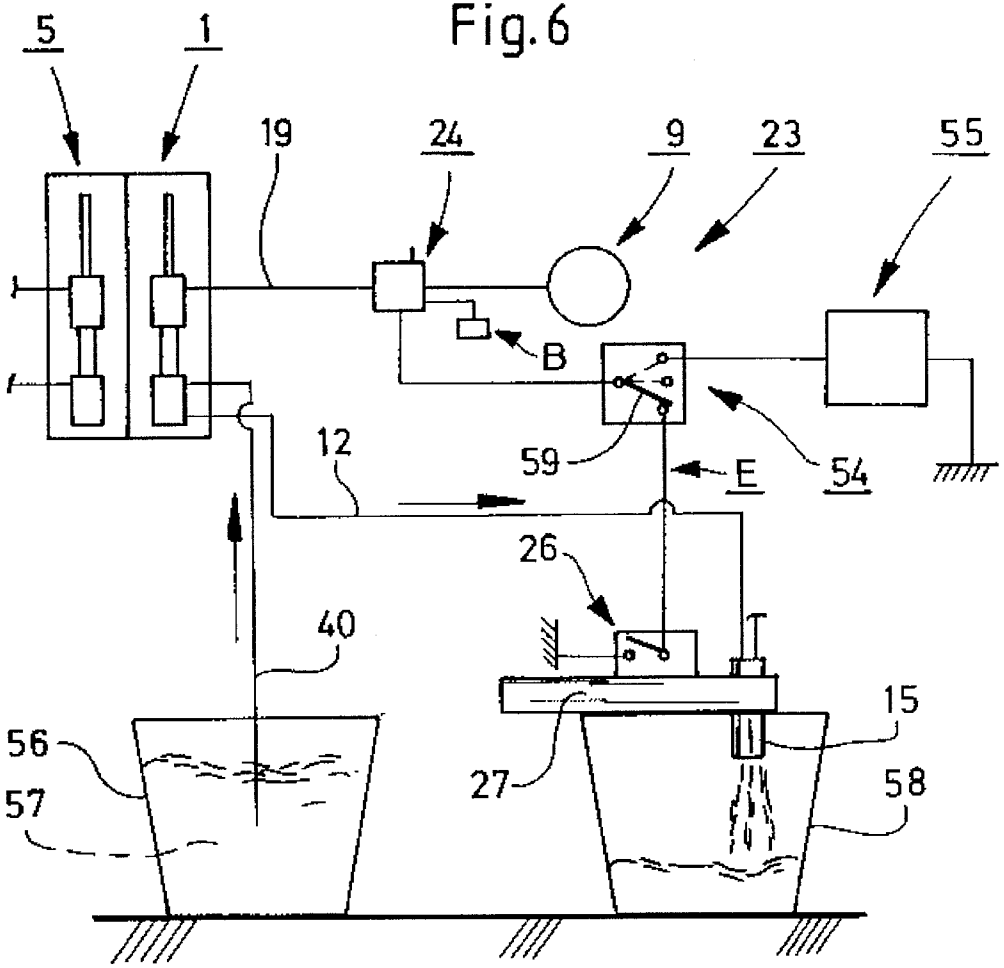
FIG. 6 illustrates the portioning arrangement according to the invention schematically during a pumping-clean operation.

Units 1 and 5 are primarily identical or in any case very similar, and each such unit 1 and 5 exhibits a drive arrangement 8 that is powered by a medium under pressure, primarily compressed air, and which is therefore connected to a pressure medium source 9, primarily a compressed air source 9. The drive arrangement 8 is intended to impart to a dispensing device 10 portioning strokes (see arrow P in FIG. 2) so as to portion out ketchup 2 or mustard 6 from a portioning chamber 11 and from this via a portioning tube 12 and nozzle openings 13 for ketchup 2 or mustard 6, as the case may be, in a portioning nozzle 15. Further, the drive arrangement 8 is intended to impart to dispensing device 10 return motions (see arrow R in FIG. 2) after the portioning stroke P so as to generate such a negative pressure in portioning chamber 11 that ketchup 2 or mustard 6, as the case may be, is drawn into portioning chamber 11 from container 3 or 7, as the case may be.

Drive arrangement 8 is designed as a cylinder-piston arrangement that exhibits a cylinder 16 with a drive piston 17. The internal space of cylinder 18 communicates with the pressure medium source 9 via line 19, and drive piston 17 is pushed in the direction indicated by arrow P because the pressure in the internal space 18 increases. When the drive piston 17 is driven in the direction P, a coil spring 20, which is slipped over an outward-directed part 21 of drive piston 17 and which is situated between cylinder 16 and a nut device 22, so arranged that it can be screwed on the outward-directed part 21, is tensioned.

In order to control the pressure increase in the internal space 18 of cylinder 16, the portioning arrangement exhibits an electrically-powered control arrangement 23. This includes a control valve 24 which can be controlled to open the line 19 connecting pressure medium source 9 and internal space 18. Control valve 24 also exhibits an air outlet 25 which allows air to flow out of the internal space 18 after each portioning stroke so that coil spring 20 can impart to the drive piston 17 its return motion P. The spring force of coil spring 20 is variable by increasing or decreasing the distance between nut device 22 and cylinder 16 when the drive piston is stationary. The portioning stroke can be limited by means of a sleeve 60 which is slipped over the outward-directed part 21.

Pressure medium source 9 and control arrangement 23 are common to the drive arrangement 8 of both units 1 and 5.

Control arrangement 23 exhibits an electrical circuit E which is connected to a current source B, eg a battery. In addition to control valve 24, the electrical circuit E includes a manually-operable switch 26 which is arranged on an operating lever 27 which exhibits the portioning nozzle 15 and which is held in the hand when portioning takes place. Every time the switch 26 is closed, control valve 24 is activated to open the connection between pressure medium source 9 and drive arrangement 8 to portion out foodstuff.

Figure 7:
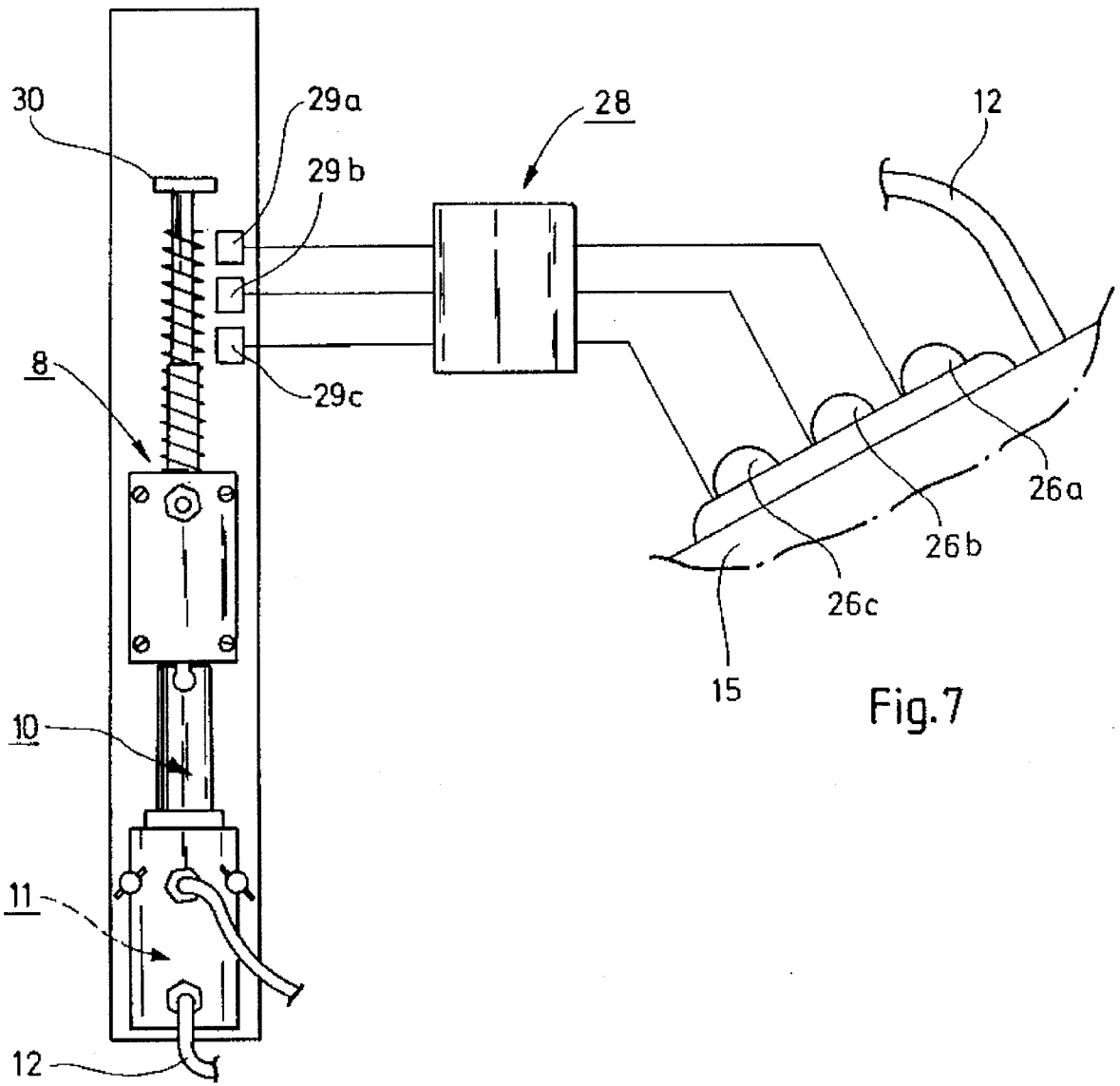
FIG. 7 illustrates a part of an alternative embodiment of the portioning arrangement according to the invention.

As FIG. 7 shows, control arrangement 23 may exhibit a stroke length control arrangement 28 so that portions of different sizes may be dispensed. This may exhibit a number of switches, eg three, **26*a*, 26*b*, 26*c* on operating lever 27 and a corresponding number of limit position devices 29*a*, 29*b*, 29*c*. A stop device 30 on the outward-directed part 21 of drive piston 17, shown schematically, interacts with these so that the motion of drive piston 17 is stopped at limit position device 29*a* when the stop device reaches this, when the switch 26*a* is activated, whereupon a small portion is dispensed since the portioning stroke of drive piston 17 is then smallest. When switch 26*b* is activated, stop device 30** is stopped at limit position device 29*b*, whereupon a larger portion is dispensed, and when switch 26*c* is activated, an even larger portion is dispensed, since the portioning stroke of drive piston 17 and thus of dispensing device 10 is then greatest.

In the portioning procedure, it may initially be essential, inter alia to save time, to perform significantly longer portioning strokes than later when dispensing small portions, so that portioning chamber 11 and portioning tube 12 are rapidly filled with the relevant foodstuff 2 or 6, as the case may be. To perform this, drive arrangement 8 may exhibit a ring 32 that can turn on cylinder 16. This ring 32 has a handle 33 to make it easier to turn, and it exhibits a number (for example two) of stop pins 34 that run parallel with the outward-directed part 21 of drive piston 17. The outward-directed part 21 has, at nut device 22, a stop washer 3,5 with holes 36 for stop pins 34. This stroke length increasing arrangement 31 works as follows: when the stroke length of drive piston 17 and with it dispensing device 10 must be increased in order initially to quickly draw up the requisite amount of foodstuff 2 and/or 6 from the respective container 3 and/or 7, ring 32 is positioned so that holes 36 in stop washer 35 will be positioned opposite stop pins 34. In this way, washer 35 is not stopped by stop pins 34 but can slide along them, whereupon drive piston 17 and with it dispensing device 10 can perform a long intake stroke. These long intake stokes may continue until portioning chamber 11 and portioning tube 12 are completely filled with foodstuff. After this, ring 32 can be turned so that stop pins 34 stop the stop washer 35, giving a stroke length that is required for dispensing predetermined portions.

Dispensing device 10 is designed as a dispensing piston 37, which is movable in portioning chamber 11. This is formed by a dispensing unit 38, and exhibits a rear part 39 which communicates via a tube 40 with foodstuff container 3 or 7, as the case may be, and a front part 41 which communicates with portioning tube 12. The rear part 39 has a slightly bigger diameter than dispensing piston 37, whilst the diameters of dispensing piston 37 and front part 41 are so accurately matched to each other that the seal between them is good enough for dispensing of foodstuff from the portioning chamber to take place without the foodstuff, or at least without significant amounts of the foodstuff, penetrating between the sides of dispensing piston 37 and portioning chamber 11. This means that the use of extra sealing devices to achieve the said seal is avoided, and therefore dispensing piston 37 and portioning chamber 11 are significantly easier to clean.

Dispensing piston 37 is also a good fit in an entry 42 via which it passes into portioning chamber 11. To prevent air being drawn into portioning chamber 11 via this entry, there is arranged externally at dispensing unit 38 a sealing device 43 which tightly surrounds dispensing piston 37.

In order to be able easily to remove dispensing piston 37 from drive piston 17, drive piston 17 exhibits a male part 44 in the form of an expanded end piece, whilst dispensing piston 37 exhibits a female part in the form of a groove in dispensing piston 37. This groove is open in the transverse direction in relation to the direction of motion P, R of drive piston 17, so that the end piece formed by the male part 44 can be inserted into and withdrawn from the groove by being moved in said transverse direction. This provides a simple quick-release coupling 46 that allows dispensing piston 37 and with it the other foodstuff-carrying parts 38, 40, 12 to be removed easily and without tools from the drive arrangement 8 for cleaning of said parts.

Dispensing unit 38 may be arranged on a stand, e.g. a stand plate 47 with the aid of a quick-release coupling 48 so that it can be removed for cleaning easily and without tools. This quick-release coupling may exhibit two arms 49 and 50 which can rotate in stand plate 47 and which can project upward from this so that they engage with two grooves 51, 52 on opposite sides of dispensing unit 38. Each arm 49, 50 has at the top a pin 53 and the arms 49, 50 can be turned so that these pins 53 either lock dispensing unit 38 at the stand plate 47 or release dispensing unit 38 for removal from stand plate 47.

Since dispensing device 10 is releasable from drive piston 17 of drive arrangement 8 as mentioned and retractable or removable from portioning chamber 11 of dispensing unit 38, said dispensing device 10 and portioning chamber 11 are easily and efficiently cleaned separately.

Preferably, dispensing unit 38 and dispensing device 10 can be released together from drive piston 17 and thereafter, said dispensing device 10 can be retracted or removed from portioning chamber 11 of said dispensing unit 38.

Furthermore, dispensing unit 38 and dispensing device 10 are preferably removable from stand plate 47 together while at the same time dispensing device 10 is removable from drive piston 17.

This can be done by moving dispensing unit 38 and dispensing device 10 together in the transverse direction relative to the direction of motion P, R of drive piston 17.

Tube 40 for transferring foodstuff 2 and/or 6 from foodstuff container 3 and/or 7 to portioning chamber 11 is removably mounted on dispensing unit 38 and portioning tube 12 for portioning-out foodstuff from said portioning chamber 11 is also removably mounted on said dispensing unit 38 for being able to separately clean said dispensing unit and/or its portioning chamber 11 without the tubes connected thereto.

Portioning tube 12 has a substantially smaller inner diameter and is substantially longer than said tube 40 or similar conduit. Portioning tube 12 preferably has an inner diameter which is only about one quarter of the inner diameter of tube 40 and said portioning tube 12 is at least three times longer, preferably more than four times longer than tube 40. Portioning tube 12 consists of flexible material and has an inner diameter of about 4 mm, an outer diameter of about 6 mm and a length of at least 1,5 m, whereby tube 40 has an inner diameter of about 16 mm and a length of 1 m at the most. Portioning tube 12 preferably consists of such a material that it resists such positive pressure that arise inside it when portioning-out foodstuff 2 and/or 6 without expanding to any significant extent, and it preferably has such length and elasticity that operating lever 27 can be moved from one food item 4 to another food item 4 and moreover easily directed so that foodstuff 2 and/or 6 is dispensed in the appropriate direction to strike the food item at the correct place.

Between portioning chamber 11 and portioning nozzle 15 there is preferably a clean passage such that foodstuff in portioning tube 12 can flow from portioning tube 12 back to said portioning chamber 11 when dispensing device 10, after a portioning stroke P, is subjected to a return motion R. This free passage is preferably obtained while one or more non-return valve devices are lacking between portioning chamber 11 and nozzle 15.

Figure 5:
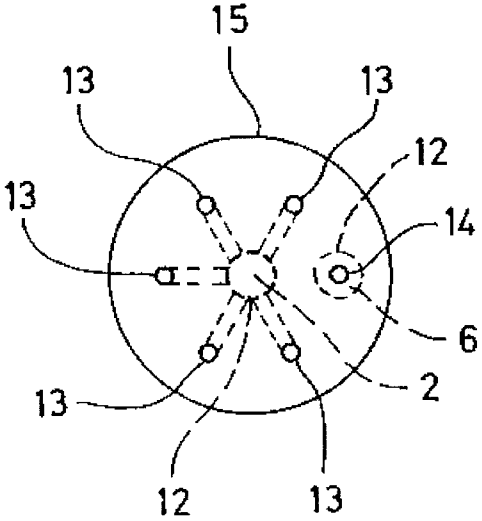
FIG. 5 illustrates an end face of the portioning nozzle according to FIG. 4.

In this case there are arranged in portioning nozzle 15, six portioning openings 13, 14, and these are so positioned that they form a portioning circle (see FIG. 5). Five portioning openings 13 are arranged to dispense ketchup 2 so as to form five spots of ketchup arranged in a ring on hamburger 4, whilst the sixth portioning opening 14 is arranged to dispense one spot of mustard in the ring formed by spots of ketchup.

Portioning tube 12 is arranged to subject foodstuff inside it—in this case ketchup 2 and mustard 6—to such resistance to flow that this foodstuff—or significant portions of it—are prevented from flowing back from portioning tube 12 to portioning chamber 11 if the said foodstuff 2 or 6 is subjected to the negative pressure generated in portioning chamber 11. This ensures that no, or no significant amounts of, foodstuff 2 and/or 6 can flow back from portioning chamber 11 when dispensing device 10 is driven to perform its return motion R in order to create the negative pressure in portioning chamber 11 that is required in order to draw in foodstuff 2 or 6 from foodstuff container 3 or 7, and this can happen without the need for special non-return valves or restrictors that may make internal cleaning more difficult.

To overcome the resistance to flow exerted by portioning tube 12 on the foodstuff 2 or 6 inside it and/or to quickly achieve exact portions, drive arrangement 8 is primarily arranged to drive dispensing device 10 so that dispensing device 10 produces a portioning pressure of at least 10 bar, primarily 16–30 bar, in portioning chamber 11. This is achieved by the necessary positive pressure being created by pressure medium source 9 in the internal space 18 of drive arrangement 8.

For portioning out ketchup 2 or mustard 6 or other foodstuffs with similar viscosity, the relevant portioning tubes 12 may primarily consist of flexible material and for example exhibit a bore of about 4 mm, an outside diameter of about 6 mm and a length of at least 0.5 m. Furthermore, each portioning tube 12 is primarily so designed that it withstands positive pressure created inside it without expanding or in any case without expanding significantly. This ensures the dispensing of exact portion amounts. In addition, dispensing device 10 and/or portioning tubes 12 are so arranged that only a part of the foodstuff 2 and/or 6 inside it/them is dispensed at each portioning out. The length and/or rigidity of portioning tube 12 are primarily so chosen that operating lever 27 and with it portioning nozzle 15 can easily be moved from one hamburger to another and can also easily be aimed so that the dispensed jets of foodstuff are delivered in the right direction to strike the hamburgers 4 at the correct place.

With the said manual operation of the portioning arrangement with the aid of switch 26 and with stroke length increasing arrangement 31 set for a long stroke of dispensing device 10, this will initially perform long strokes and cause negative pressure in portioning chamber 11 when it moves in the front part 41 of portioning chamber 11. When dispensing device 10 has been withdrawn to the rear part 39, portioning chamber 11 communicates with ketchup container 3 via tube 40 and because of the negative pressure in portioning chamber 11, ketchup will be drawn up from ketchup container 3 to portioning chamber 11. These operations are continued until portioning chamber 11 and portioning tube 12 are full, after which the stroke length increasing arrangement is reset so that dispensing device 10 from then on moves with a stroke length that corresponds to the portions to be delivered.

The interior of the portioning arrangement can be primarily be flushed clean during a flushing sequence whose duration can be set and which can be controlled with the aid of control arrangement 23. A switching arrangement 54 that permits switching of the electrical circuit E from manual control of the portioning-out operations with the aid of switch 26 to automatic control of the flushing-out operation with the aid of a pulse transmitter 55 is proven to help effect the flushing sequence. To perform the said flushing-out, the ketchup container 3 is removed from tube 40 and the end of tube 40 is placed in a container 56 with detergent liquid 57. Portioning nozzle 15 is placed in or on a collecting container 58. Switching arrangement 54 is then operated so that a contact device 59 or similar is moved from a position in which it closes circuit E between switch 26 and control valve 24 to a position in which it instead closes circuit E between pulse transmitter 55 and control valve 24 (if contact device 59 is set to a neutral position indicated by a dash-dotted line, both circuits are broken). When the circuit between pulse transmitter 55 and control valve 24 is closed, pulse transmitter 55 is started, and delivers, for a settable time during which the cleaning sequence is to last, and at set intervals, control pulses to control valve 24 so that, at every incoming pulse, control valve 24 opens the connection between portioning chambers 9 and drive arrangement 8. On each control pulse, drive arrangement 8 drives dispensing device 10 to pump out detergent liquid 57 via portioning tube 12 and portioning nozzle 15 to collection container 58 and to draw in new detergent liquid 57. The length of the flushing sequence is chosen so that all the interior of the portioning arrangement and foodstuff-carrying parts are flushed clean.

As the drawings show, the first unit 1 for portioning out ketchup 2 and the second unit 5 for portioning out mustard 6 are of identical or in any case closely similar design, but this is not necessary. Both units 1 and 5 have primarily the same or similar portioning tubes 12 and these are connected to the common portioning nozzle 15. The drive arrangements 8 of the two units 1, 5 are thus driven by the common pressure medium source 9 and controlled by the common control arrangement 23 but the stroke length of dispensing device 10 of units 1, 5 may primarily be individually settable.

The subject of the present invention is not limited to the embodiment described above and shown on the drawings, but may vary within the framework of the claims below. As examples of alternatives it may be mentioned that the subject of the invention may exhibit only one unit 1 or 5 for portioning out only one foodstuff; the foodstuff need not be ketchup 2 or mustard 6 but may be of another type with similar viscosity or may exhibit a different viscosity; the food 4 may be of a type other than a hamburger; the coil spring 20 may be a return device of another type; control arrangement 23 may be of another type than that shown and this also applies, for example, to drive arrangement 8, dispensing device 10, portioning chamber 11, portioning tubes 12 and portioning nozzle 15.

Finally it may be mentioned that primarily all parts that come into contact with foodstuff can be separated from each other, e.g. by pulling dispensing device 10 out of portioning chamber 11 and disconnecting tubes 12 and 40 from portioning chamber 11. In this way, the said parts can be individually cleaned externally and internally.

I claim:

1. Portioning arrangement for portioning out liquid foodstuffs to at least one item of food, whereby a drive arrangement (8) exhibits at least one pressure-medium-driven drive piston (17), whereby a dispensing unit (38) comprises at least one portioning chamber (11) wherein a dispensing device (10) is insertable, whereby said drive piston (17) is arranged to impart to said dispensing device (10) portioning strokes (P) for portioning out the foodstuff from said portioning chamber (11) and via at least one portioning tube (12) and a portioning nozzle (15) to the food (4), whereby said dispensing device (10) is intended to be subjected to a return motion (R) after the portioning stroke (P) in order to generate such a negative pressure in said portioning chamber (11) that the foodstuff is drawn into said portioning chamber (11) from at least one container and whereby said portioning nozzle (15) is provided on an operating lever (27) which can be held in the hand for directing said portioning nozzle (15) towards the food (4) to be provided with the foodstuff, characterized in that said dispensing device (10) is releasable from said drive piston (17) of said drive arrangement (8) and removable from said portioning chamber (11) of said dispensing unit (38) for separate cleaning of said dispensing device (10) and said portioning chamber (11).

2. Portioning arrangement according to claim 1, characterized in that said dispensing unit (38) and dispensing device (10) are releasable together from said drive piston (17) and that said dispensing device (10) thereafter is removable from said portioning chamber (11) of said dispensing unit (38).

3. Portioning arrangement according to claim 1, characterized in that said drive arrangement (8) and dispensing unit (38) are provided on a stand (47) and that said dispensing unit (38) is removable from said stand (47) together with said dispensing device (10) while at the same time said dispensing device (10) is removable from said drive piston (17).

4. Portioning arrangement according to claim 3, characterized in that said dispensing unit (38) is removable from said stand (47) while at the same time said dispensing device (10) is removable from said drive piston (17) by moving said dispensing unit (38) and dispensing device (10) together in the transverse direction relative to the direction of motion of said drive piston (17).

5. Portioning arrangement according to claim 4, characterized in that said drive piston (17) and said dispensing device (10) are connected together via a quick-release coupling (46) comprising a male part (44) and a female part (45), which can be uncoupled by being pushed relative to each other in a transverse direction relative to the direction of motion of said drive piston (17).

6. Portioning arrangement according to claim 1, characterized in that a tube (40) for transferring the foodstuff from said foodstuff container to said portioning chamber (11) is removably mounted on said dispensing unit (38) and that said portioning tube (12) for portioning-out foodstuff from said portioning chamber (11) is also removably mounted on said dispensing unit (38) for being able to clean said dispensing unit (38) and said portioning chamber (11) without said tubes (40, 12) connected thereto.

7. Portioning arrangement according to claim 1, characterized in that between said portioning chamber (11) and said portioning nozzle (15) there is a clear passage such that foodstuff present in said portioning tube (12) can flow back from said portioning tube (12) to said portioning chamber (11) when said dispensing device (10) is subjected to return motions (R) after a portioning stroke (P).

8. Portioning arrangement according to claim 7, characterized in that said clear passage for foodstuff between said portioning chamber (11) and said nozzle (15) is obtained while one or more non-return valve devices are lacking therebetween.

9. Portioning arrangement according to claim 1, characterized in that said portioning tube (12) has a substantially smaller inner diameter and is substantially longer than a tube (40) which is adapted to transfer foodstuff from said foodstuff container to said portioning chamber (11).

10. Portioning arrangement according to claim 9, characterized in that said portioning tube (12) has an inner diameter which is only about one quarter of the inner diameter of said tube (40) and that said portioning tube (12) is at least three times longer than said tube (40).

11. Portioning arrangement according to claim 1, characterized in that said portioning tube (12) consists of such material that it resists such positive pressure which arise inside it when portioning-out foodstuff without expanding to any significant extent.

12. Portioning arrangement according to claim 1, characterized in that said portioning tube (12) has such length and elasticity that said operating lever (27) can easily be moved from one food item (4) to another food item (4) and moreover can easily be directed so that foodstuff is dispensed in the appropriate direction to strike the food item (4) at the correct place.

13. Portioning arrangement according to claim 1, characterized in that said portioning tube (12) consists of flexible material and exhibits a bore of about 4 mm, an outside diameter of about 6 mm and a length of at least 1.5 m, whereby a tube (40) between said foodstuff container and said portioning chamber (11) has an inner diameter of about 16 mm and a length not greater than 1 m.

14. Portioning arrangement according to claim 1, characterized in that an electrically operated control arrangement (23) is provided to control the operation of said drive arrangement (8) and that a manually operated switch (26) is provided on said operating lever (27) for activating said drive arrangement (8) to dispense or discharge a portion of foodstuff through said portioning nozzle (15).

15. Portioning arrangement according to claim 14, characterized in that said control arrangement (23) includes a switching arrangement (54) which allows said control arrangement (23) (i) to be set to allow manual control of the portioning-out sequence for portioning out foodstuff and (ii) to be set for automatic control of a time-settable flushing sequence during which detergent liquid (57) is drawn by said dispensing device (10) into said portioning chamber (11) and is portioned out from this via said portioning tube (12).

16. Portioning arrangement according to claim 15, characterized in that said switching device (54) in being set for manual control of the portioning-out sequence allows said control arrangement (23) to be operated with the aid of said manually operated switch (26) which on every activation allows said control arrangement (23) to control said drive arrangement (8) to impart to said dispensing device (10) a portioning-out stroke and that said switching arrangement (54) in being set for automatic control of the flushing sequence allows said control arrangement to be operated by a pulse transmitter (55) that can deliver a number of pulses during a certain time to a control valve (24) in said control arrangement (23) which is controlled to open on each received pulse a connection between a pressure medium source (9) and said drive arrangement (8), so that this applies a flushing stroke to said dispensing device (10).

17. Portioning arrangement according to claim 1, characterized in that said dispensing device (10) engages with such accuracy in said portioning chamber (11) that there arises between said dispensing device (10) and said portioning chamber (11) sufficient sealing for said dispensing device to be able to dispense foodstuff without the need for special sealing devices between said dispensing device (10) and said portioning chamber (11).

18. Portioning arrangement according to claim 1, having an external sealing device (43) arranged to prevent air from being drawn from outside into said portioning chamber (11) through an entry (42) for said dispensing device (10), and said dispensing device (10) being withdrawable from said portioning chamber (11) via said entry (42) to facilitate cleaning of both said dispensing device (10) and said portioning chamber (11) via said entry (42).

19. Portioning arrangement according to claim 1, characterized in that said drive arrangement (8) includes a stroke length changing arrangement (28) which permits changing of the length of stroke of said dispensing device (10) as a function of the amount of foodstuff that is to be portioned out.

20. Portioning arrangement according to claim 1, characterized in that said drive arrangement (8) includes a stroke length increasing arrangement (31) which permits a greater stroke to be imparted to said dispensing device (10) for initial induction of foodstuff into said portioning chamber (11) and thereafter permits a significantly shorter stroke length to be imparted to said dispensing device (10) for subsequent portioning-out of foodstuff.

21. Portioning arrangement according to claim 1, characterized in that said pressure-medium-driven drive piston (7) interacts with said dispensing device (10) such that said drive piston (7), when acted upon by said pressure medium, imparts to said dispensing device (10) portioning strokes, and said drive arrangement (8) exhibits at least one return device (20) to return said dispensing device (10) after completion of portioning-out stroke so that said dispensing device (10) draws in foodstuff from said foodstuff container to said portioning chamber (11).

22. Portioning arrangement according to claim 21, characterized in that said return device comprises at least one coil spring (20), said coil spring (20) being tensioned when said drive piston (17) is acted upon by said pressure medium and thereby said coil spring (20) capable of returning said drive piston (17) and with it said dispensing device (10) so that said dispensing device (10) achieves sufficient negative pressure in said portioning chamber (11) to draw in foodstuff from said foodstuff container therein.

23. Portioning arrangement according to claim 1, characterized in that said drive arrangement (8) includes a first unit (1) for portioning out a first foodstuff (2) via a first portioning tube (12), and a second unit (5) for portioning out a second foodstuff (6) via a second portioning tube (12), said portioning tubes (12) dispense the firsthand second foodstuffs (2 and 6) through one portioning nozzle (15) and that the strokes of a dispensing device (10) of the first unit (1) or of a dispensing device of the second unit (5) can be individually set.

24. Portioning arrangement according to claim 23, characterized in that said drive arrangements (8), dispensing device (10), portioning device (11) and portioning tubes (12) of both units (1 and 5) are of a similar design.

25. Portioning arrangement according to claim 1, characterized in that a first drive arrangement (8) in a first unit (1) and a second drive arrangement (8) in a second unit (5) are powered by a single pressure-medium source (9) and are controlled by a common control arrangement (23).

* * * * *

UNITED STATES PATENT AND TRADEMARK OFFICE

CERTIFICATE OF CORRECTION

PATENT NO. : 5,542,574
DATED : August 6, 1996
INVENTOR(S) : Leif E. Stern

It is certified that error appears in the above-indentified patent and that said Letters Patent is hereby corrected as shown below:

Column 10, line 14, change "firsthand" to --first and--.

Signed and Sealed this

First Day of July, 1997

Bruce Lehman

*Attest:*

BRUCE LEHMAN

*Attesting Officer*

*Commissioner of Patents and Trademarks*